US008134091B2

(12) United States Patent
Basilico

(10) Patent No.: US 8,134,091 B2
(45) Date of Patent: Mar. 13, 2012

(54) ELECTRONIC MANUALLY CONTROLLABLE ADJUSTMENT DEVICE

(75) Inventor: Alberto Basilico, Caronno Pertusella-Varese (IT)

(73) Assignee: BTICINO S.p.A., Milan (IT)

( * ) Notice: Subject to any disclaimer, the term of this patent is extended or adjusted under 35 U.S.C. 154(b) by 319 days.

(21) Appl. No.: 12/618,727

(22) Filed: Nov. 14, 2009

(65) Prior Publication Data

US 2010/0126839 A1 May 27, 2010

(30) Foreign Application Priority Data

Nov. 26, 2008 (IT) ..... RM2008A0628

(51) Int. Cl.
*H01H 25/04* (2006.01)

(52) U.S. Cl. ..... 200/6 A; 200/5 R; 200/331

(58) Field of Classification Search ..... 200/5 R, 200/6 A, 17 R, 18, 32–331; 174/66, 67; 362/27, 362/85, 95, 555, 558; 323/905; 307/115; 315/129, 133, 292, 294, 297, 320
See application file for complete search history.

(56) References Cited

U.S. PATENT DOCUMENTS

| | | | | |
|---|---|---|---|---|
| 5,619,021 | A * | 4/1997 | Yamamoto et al. | 200/6 A |
| 6,005,308 | A | 12/1999 | Bryde | |
| 6,762,372 | B2 * | 7/2004 | Nishimoto et al. | 200/4 |
| 6,787,716 | B1 * | 9/2004 | Menche | 200/6 A |
| 7,507,918 | B2 * | 3/2009 | Kazama | 200/6 A |
| 7,671,284 | B2 * | 3/2010 | Nourry et al. | 200/5 A |
| 2004/0020751 | A1 * | 2/2004 | Takiguchi et al. | 200/6 A |
| 2004/0159529 | A1 * | 8/2004 | Menche | 200/5 R |
| 2005/0139458 | A1 * | 6/2005 | Komatsu | 200/5 R |
| 2006/0016672 | A1 * | 1/2006 | Lee | 200/6 A |
| 2006/0108208 | A1 * | 5/2006 | Ilkhanov | 200/18 |

FOREIGN PATENT DOCUMENTS

| | | |
|---|---|---|
| DE | 19839698 | 3/2000 |
| DE | 102005013522 | 10/2006 |
| FR | 2867305 | 9/2005 |
| WO | 2007/072294 | 6/2007 |

OTHER PUBLICATIONS

EP Search Report for Italian Patent Application RM2008A000628 filed on Nov. 26, 2008 in the name of Bticino S.P.A.

* cited by examiner

*Primary Examiner* — Michael Friedhofer
(74) *Attorney, Agent, or Firm* — Steinfl & Bruno LLP

(57) ABSTRACT

An electronic manually controllable adjustment device for adjusting electric power provided to an electric load connectable to the device is described. The device comprises first switching elements, a tilting control button which may interact with the first switching elements, and first hinge elements for defining a first hinge axis allowing rotation of the control button around the first axis between a first operating position and a second operating position. The control button can interact with the first switching elements when reaching the first and second operating position. The device further comprises second switching elements and second hinge elements. The second hinge elements can define a second hinge axis perpendicular to the first hinge axis and allow rotation of the control button around the second hinge axis for actuation of the second switching elements.

9 Claims, 7 Drawing Sheets

ELECTRONIC MANUALLY CONTROLLABLE ADJUSTMENT DEVICE

CROSS REFERENCE TO RELATED APPLICATIONS

The present application claims priority to Italian patent application No. RM2008A000628 filed on Nov. 26, 2008, incorporated herein by reference in its entirety.

FIELD

The present disclosure concerns the field of electronic apparatuses for controlling and adjusting and, more specifically, it refers to an electronic manually controllable adjustment device.

With particular reference to the field of applications in civil buildings, such as houses and the like, it is known and ever more widespread to use electronic adjustment devices which are manually controllable, commonly called "dimmers", which are used to adjust the power absorbed by an electric load associated with it. Such devices are, for example, normally used for adjusting the light intensity of one or more lamps electrically connected to the devices themselves.

Dimmers have control systems including respective control members which the user can act upon manually to control and adjust the power to be provided to the load. Known control systems are made in various ways. For example, some types of dimmers use control systems in which the control member is made through a button or tilting key which can rotate around a respective rotation axis. Other types of dimmers adopt sliding control systems, in which the control member is a slider that slides along a respective sliding axis, or they adopt rotary systems, in which the control member is a rotatable handle, or systems that use a combination of the two previous systems. Yet other types of dimmers include touch sensitive control systems instead.

SUMMARY

According to a first aspect, an electronic manually controllable adjustment device for adjusting electric power provided to an electric load connectable to the device is provided, wherein the device comprises: first switching elements including a first switching device and a second switching device; a tilting control button adapted to interact with said first switching elements; first hinge elements, for defining a first hinge axis for allowing the control button to rotate around said first hinge axis, between a first operating position and a second operating position angularly spaced therebetween, the control button adapted to interact with said first switching elements for respectively actuating the first switching device and the second switching device when reaching the first operating position and the second operating position; second switching elements; and second hinge elements for defining a second hinge axis perpendicular to first hinge axis, said second hinge elements adapted to allow rotation of the control button around the second hinge axis, between a third operating position and a fourth operating position angularly spaced therebetween, for actuation of the second switching elements.

Further aspects of the disclosure are provided in the specification, claims and drawings of the present application.

BRIEF DESCRIPTION OF THE DRAWINGS

The present disclosure shall become clearer from the following detailed description of embodiments, given as an example and not as a limitation, in which.

DESCRIPTION OF EXAMPLE EMBODIMENTS

Figure 1:
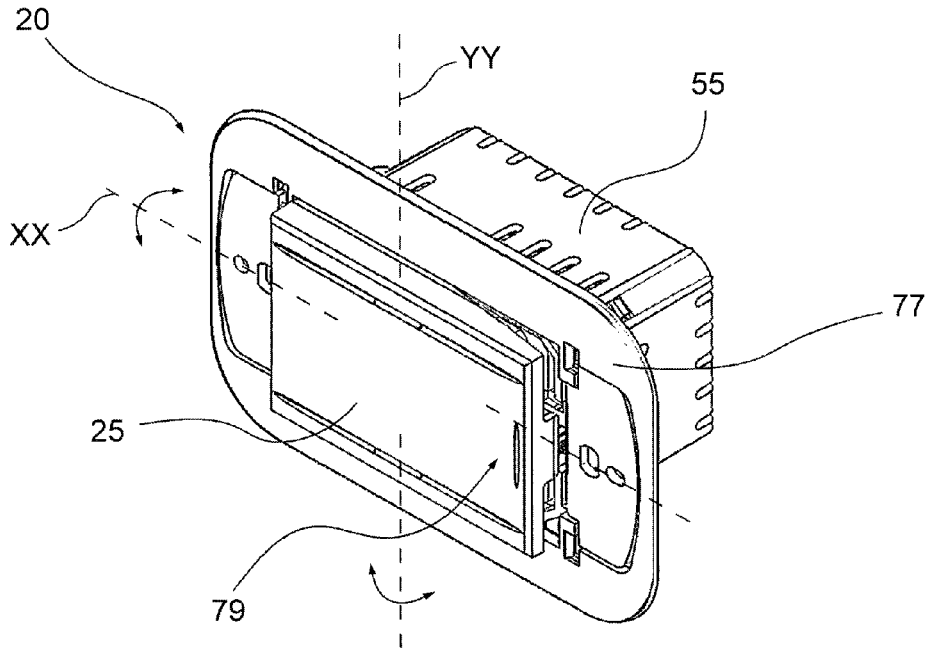
FIG. 1 is a perspective view of an electronic manually controllable adjustment device.
Figure 2:
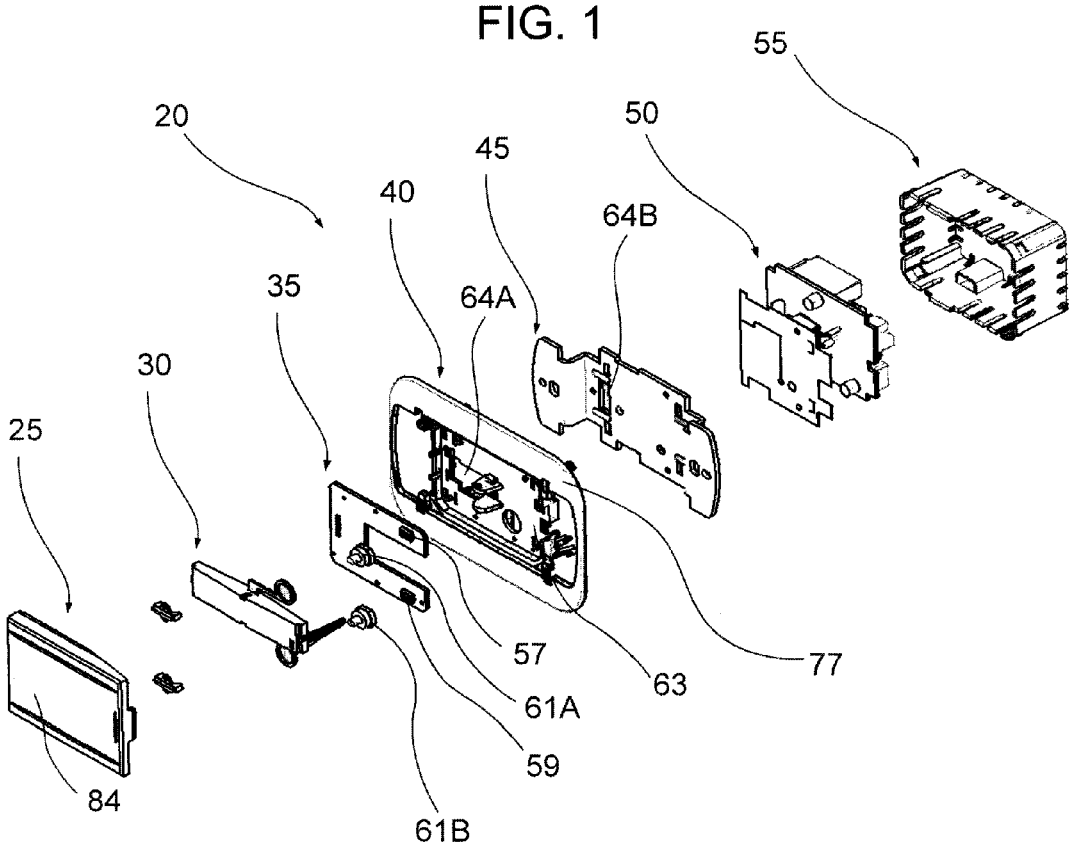
FIG. 2 is a perspective and exploded view of the device of FIG. 1.

With initial reference to FIGS. 1 and 2, an electronic manually controllable adjustment device is being indicated in its entirety with reference numeral 20. In the example illustrated, the device 20 is a dimmer suitable for being flush mounted into a wall, for adjusting the electric power provided to an electric load R (shown in FIG. 13) connected to the dimmer itself. According to an embodiment of the disclosure, the electric load R can comprise at least one lamp, the light intensity of which can be adjusted through the dimmer.

With reference to the exemplary illustration of FIG. 2, the dimmer comprises: a substantially plate-like tilting control button 25; a rotatable connection member or rocker 30; a command acquisition circuit 35 suitable for providing control signals in output in response to control movements of the button 25; a support frame 40; a heat dissipator 45; an adjustment circuit 50 suitable for receiving the control signals provided in output by the acquisition circuit 35; and a housing box or case 55.

Figure 3:
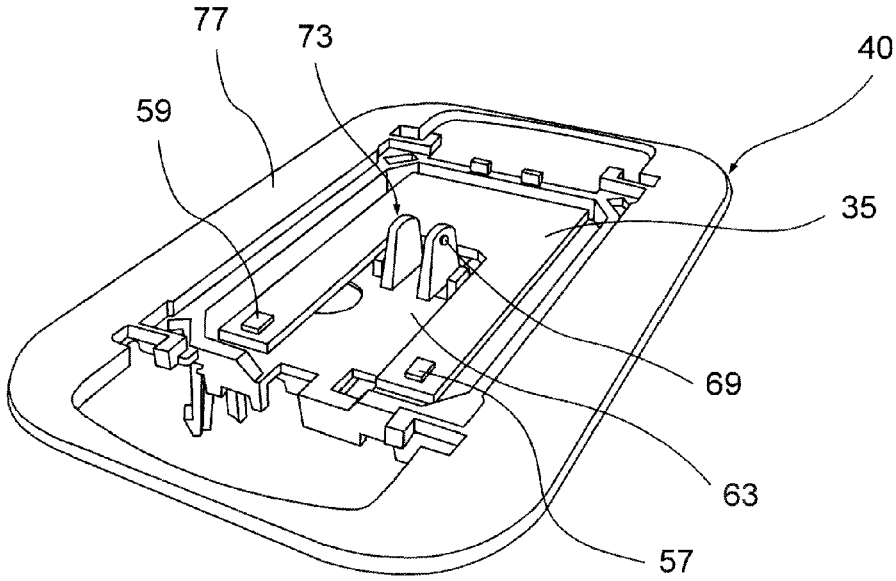
FIG. 3 is a perspective view of a first component of the device of FIG. 1.

With reference to the exemplary illustration of FIGS. 2 and 3, the dimmer 20 includes first switching elements 57, 59, suitable for interacting with the tilting control button 25. The first switching elements include a first switching device 57 and a second switching device 59 arranged on the acquisition circuit 35. More particularly, in the present example, the first switching elements comprise a first and a second micro-switch SMD 57, 59 (schematically represented in the figures) including respective elastic caps or covering gaskets 61A, 61B.

According to an embodiment of the present disclosure, the acquisition circuit 35 can be a printed circuit suitable for being housed in a respective housing seat 63 provided in the support frame 40. In particular, such a circuit comprises electric connecting elements (not represented in the figures) suitable for sending the control signals to the adjustment circuit 50 provided in response to the operative positions taken on by the control button 25. In the present example, the electric connecting elements are connection pins (not represented in the figures) suitable for passing through the through openings 64A, 64B (FIG. 2) respectively provided in the support frame 40 and in the heat dissipator 45 to make the connection with the adjustment circuit. The adjustment circuit 50, which in the example is intended to be housed in a compartment of the housing box 55, can also be made through a printed circuit and is suitable for processing the control signal received by the acquisition circuit for adjusting the electric power output from the dimmer 20.

Figure 4:
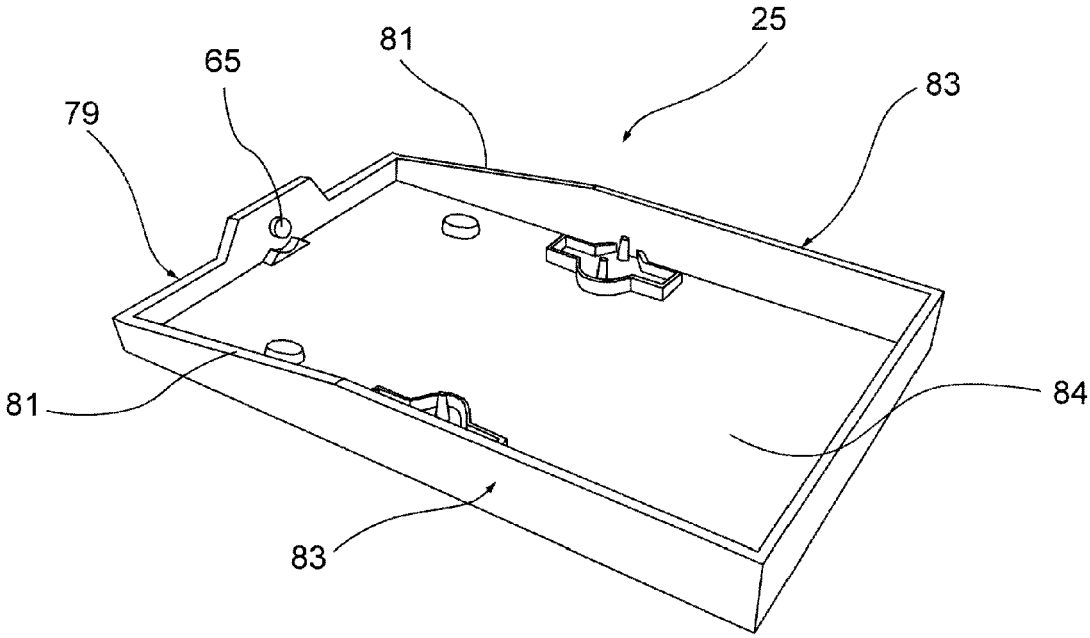
FIG. 4 is a perspective view of a second component of the device of FIG. 1.
Figure 5:
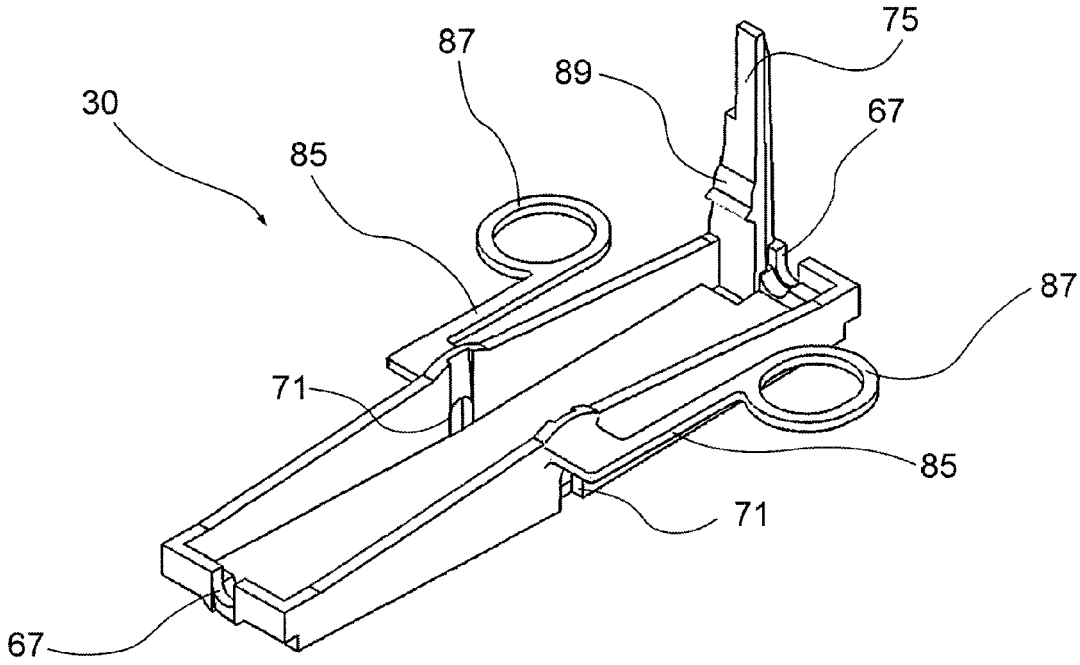
FIG. 5 is a perspective view of a third component of the device of FIG. 1.
Figure 6:
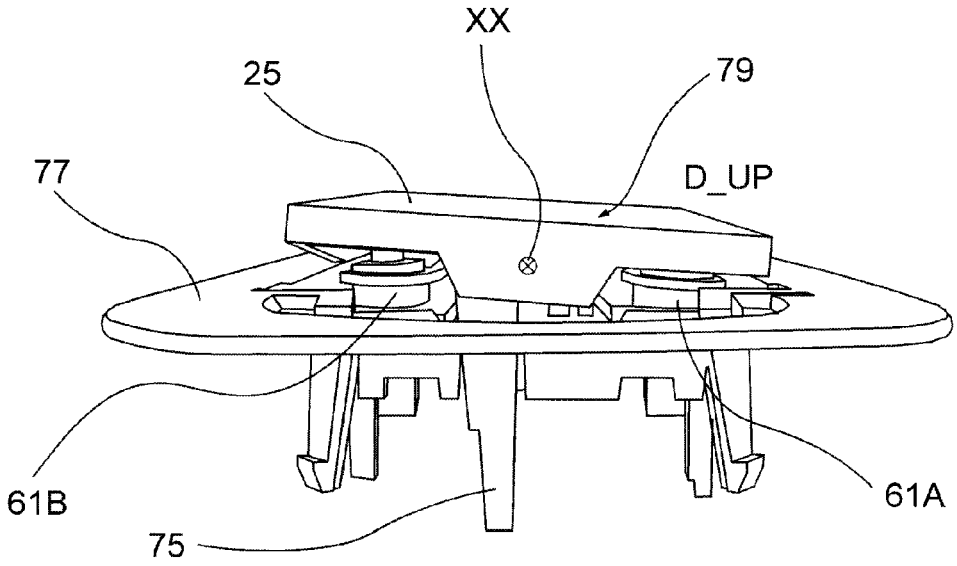
FIG. 6 is a perspective view of a group of parts comprising the components of FIGS. 3, 4 and 5 assembled with one another, in which the group is represented in a first operating arrangement.
Figure 7:
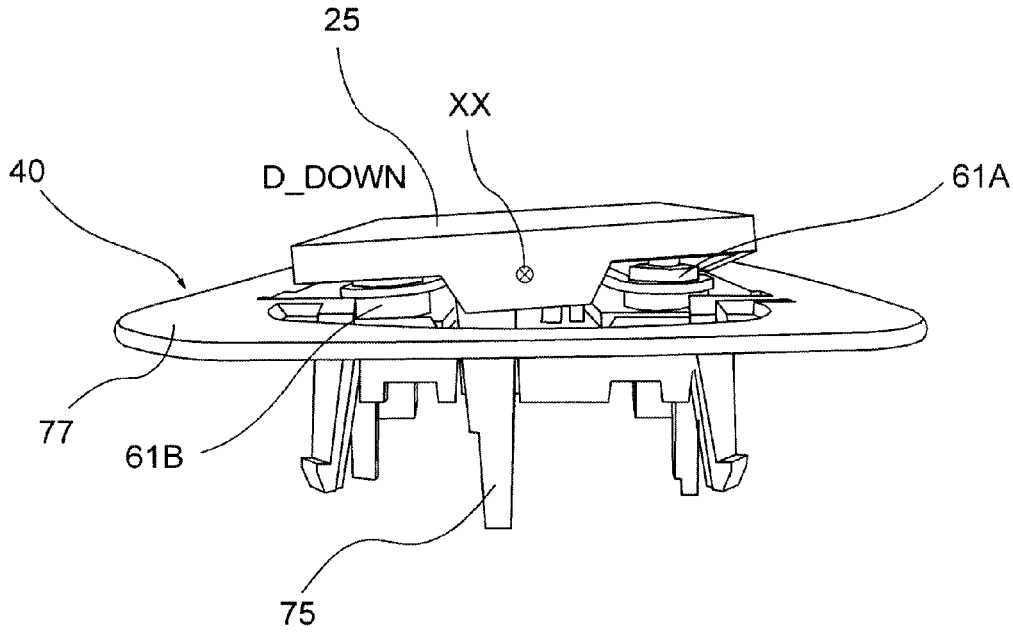
FIG. 7 is a perspective view of the group of parts of FIG. 6 represented in a second operating arrangement.
Figure 8:
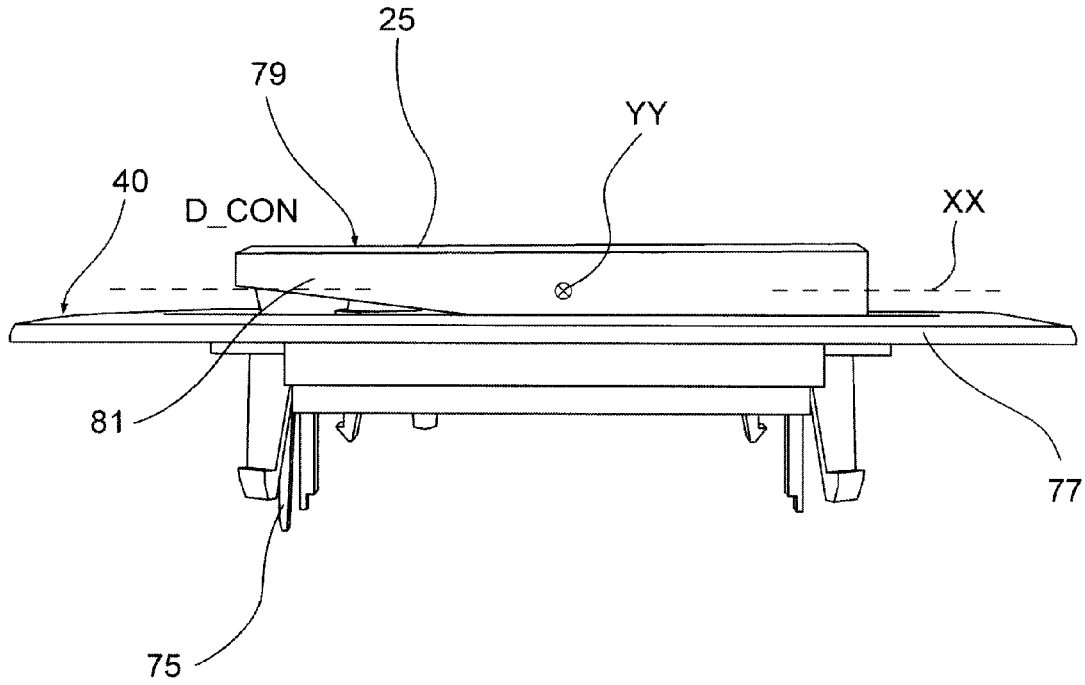
FIG. 8 is a perspective view of the group of parts of FIG. 6 in which the group is shown at a different angle and is represented in a third operating arrangement.

With reference to the representation of FIGS. 4 and 5, the dimmer comprises first hinge elements 65, 67 suitable for defining, in the assembled configuration of the dimmer, a first rotation axis XX or adjustment axis (FIGS. 1, 6 and 8) to allow the control button 25 to rotate around such axis from a first operating position D_UP (FIG. 6) to a second operating position D_DOWN (FIG. 7), which are angularly spaced apart. The adjustment axis XX is schematically represented in FIG. 6 with a circled "x" to indicate that it is an axis entering the sheet in a substantially perpendicular direction with respect to such figure. However, the axis XX is represented in FIGS. 1 and 8 with a broken line.

In accordance with an embodiment of the dimmer 20, the first hinge elements 65, 67 include a pair 65 of opposite pins (only one of which can be seen in FIG. 4) provided on the control button 25 and a pair of opposite hooking recesses 67 (FIG. 5) provided on the rotatable connection member 30. More in particular, the pins 65 are suitable for removably snap-hooking onto the hooking recesses 67 to allow relative rotation between the button 25 and the rotatable connection member 30.

As a consequence of the aforementioned first hinge elements, the control button 25 may interact with the micro-switches 57, 59 for actuating the first micro-switch 57 and the second micro-switch 59, respectively, when the control button 25 is in the respective D_UP and D_DOWN positions.

In accordance with one embodiment, when the control button 25 is in such positions D_UP, D_DOWN, the control button is suitable for adjusting the power to be provided to the load R, represented, for example, by a single lamp. However, in a different case, not represented in the figures, the electric load could also be represented, for example, by many lamps, such as an incandescent lamp and a fluorescent lamp. In such a case, the power provided to the incandescent lamp could be adjusted, for example, when the control button 25 is in the D_UP position, whereas the power provided to the fluorescent lamp could be adjusted, for example, when the control button is in the D_DOWN position.

Figure 13:
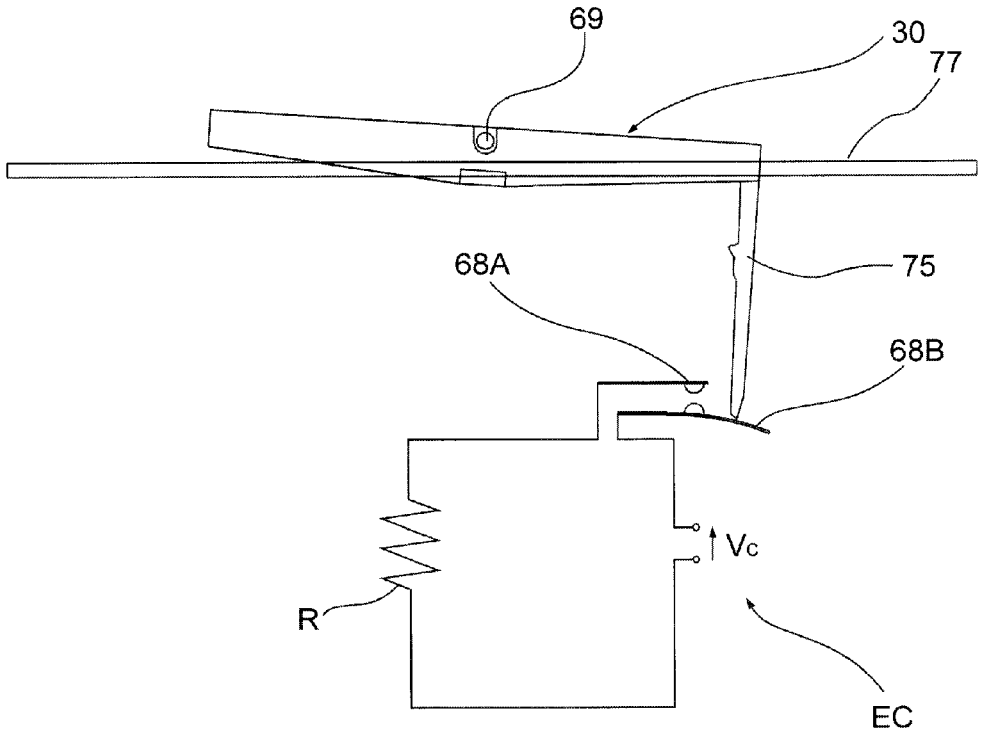
FIG. 13 is a view which schematically represents in elevation side view the component of FIG. 5 and a portion of the component of FIG. 3 and where an electric circuit fed through the electronic device of FIG. 1 is also represented.

Together with micro-switches 57, 59 the dimmer can also include second switching elements including, in the embodiment of the example, a pair of electrical contact elements or electrical contacts 68A, 68B schematically represented in FIG. 13. In such example, the electrical contacts can include at least one electrically conductive elastic strip 68B. More particularly, in the example, the electrical contacts 68A, 68B include a pair of opposite electrically conductive strips 68A, 68B.

Figure 10:
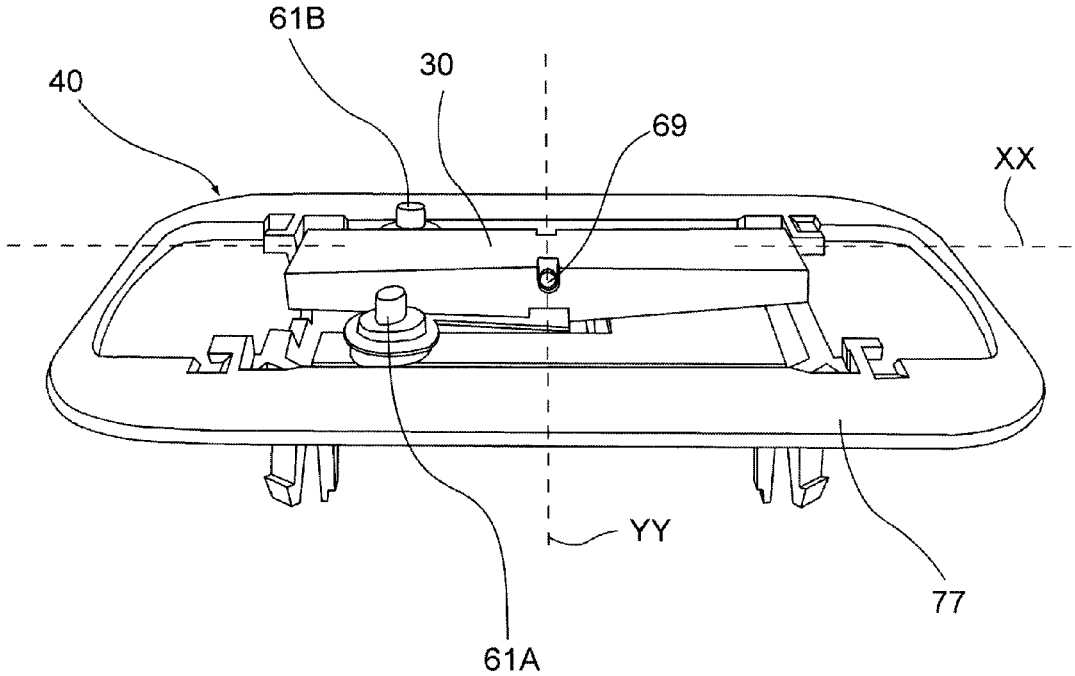
FIG. 10 is a perspective view of the group of parts illustrated in FIGS. 6 to 9 in which the component from FIG. 4 has been removed and in which the component from FIG. 5 is represented in a first operating arrangement.

With reference to the exemplary embodiments of FIGS. 3 and 5, the dimmer 20 includes second hinge elements 69, 71 suitable for defining a second hinging axis YY or load disconnection axis (FIGS. 1, 8 and 10) arranged substantially perpendicularly to the adjustment axis XX. In the embodiment of the example, the second hinge elements comprise a pair of protuberances 69 (only one of which can be seen in FIG. 3) provided on the support frame 40 and a pair of opposite hooking openings 71 (FIG. 5) formed on the connection member 30. More in particular, the protuberances 69 are suitable for removably snap-hooking into the hooking openings 71 and are arranged on a support 73 overhanging the support frame in a substantially centered position with respect to the frame.

The second hinge elements 69, 71 allow the control button 25 to rotate around the disconnection axis YY from a third to a fourth operating position, which are angularly spaced apart to allow the actuation of the second switching elements 68A, 68B (FIG. 13). In the described example, the third and the fourth operating position of the control button correspond to a load connection position D_CON (FIGS. 8 and 14*a*) and a load disconnection position D_DIS (FIGS. 9 and 14*c*), respectively.

In the embodiment illustrated in the figures, the rotatable connection member 30 is suitable for being operatively interposed between the support frame 40 and the control button 25. In particular, the control button is hinged, through the first hinge elements 65, 67, to the rotatable connection member to rotate around the adjustment axis XX, whereas the rotatable connection member 30 is hinged, through the second hinge elements 69, 71, to the support frame 40, to rotate around the disconnection axis YY. In particular, the control button 25 is mounted to overlap the connection member 30.

In accordance with a further embodiment of the disclosure, the control button 25 is suitable for taking up a further intermediate operating position (FIG. 14*b*) which is angularly spaced between the connection position D_CON (FIGS. 8 and 14*a*) and the disconnection position D_DIS (FIGS. 9 and 14*c*) around the disconnection axis YY. When assuming the intermediate operating position, the button 25 is suitable for interacting with the micro-switches 57, 59 to simultaneously actuate such micro-switches.

In this connection, the micro-switches 57, 59 are arranged on the same side with respect to the disconnection axis YY. In the embodiment of the example, such micro-switches are, in particular, aligned with respect to one another along an axis which is substantially parallel to the disconnection axis YY. Moreover, the micro-switches 57, 59 are also arranged on two opposite sides with respect to the rotatable connection member 30.

With reference to the exemplary embodiment of FIG. 6, the dimmer comprises at least one control arm 75 arranged transversally with respect to the control button 25 and is integral with such button in its rotation around the disconnection axis YY. The control arm 75 is suitable for interacting with the electrical contacts 68A, 68B (FIGS. 13 and 14*c*) to actuate such contacts when the control button 25 is in the disconnection position D_DIS.

Figure 11:
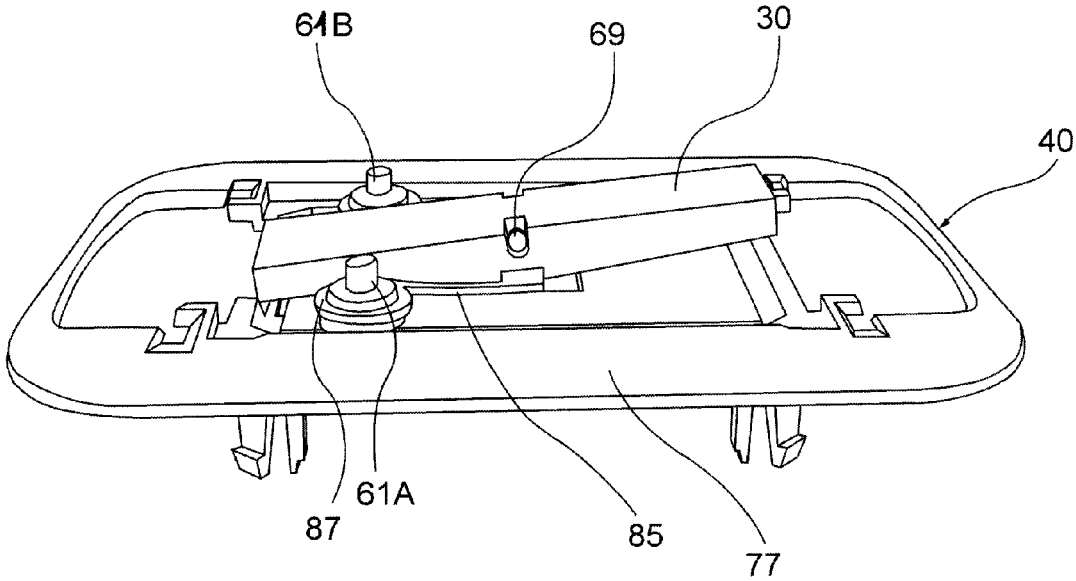
FIG. 11 is a perspective view of the group of parts of FIG. 10 in which the component of FIG. 5 is represented in a second operating arrangement.
Figure 12:
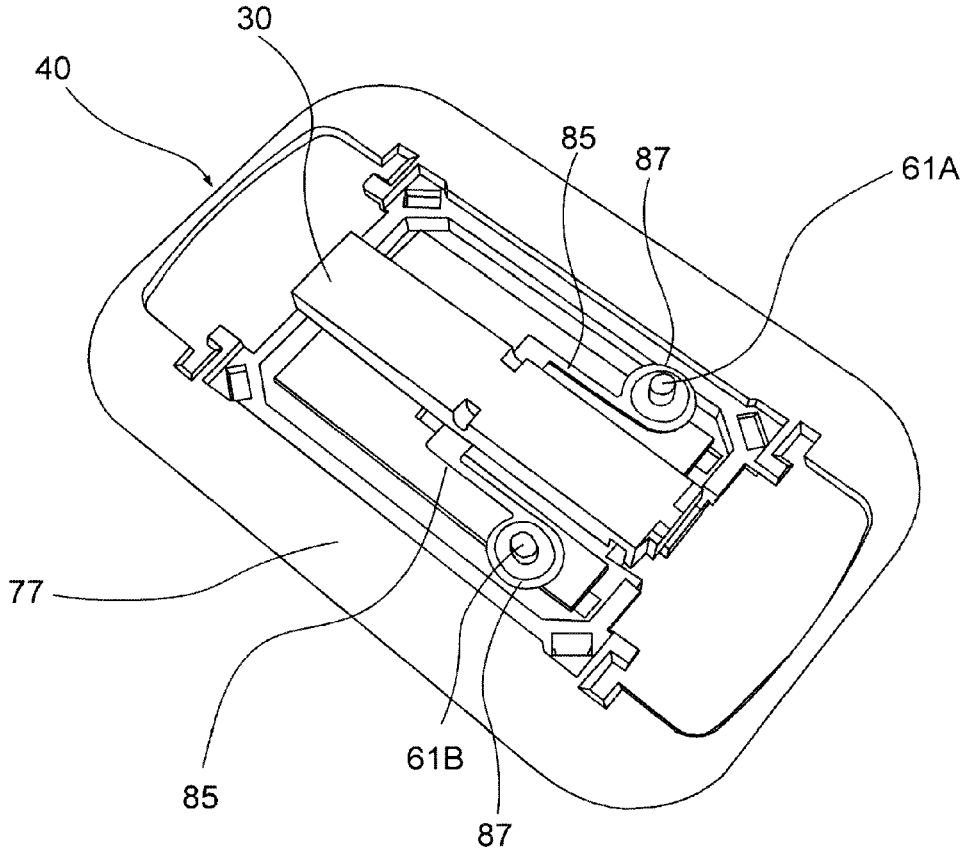
FIG. 12 is a perspective view from above of the group of parts of FIGS. 10 and 11.

In accordance with an embodiment of the disclosure, the control arm 75 is arranged on the rotatable connection member 30 (FIG. 5). In particular, such member can rotate around the disconnection axis YY from a stand-by operating position (FIG. 10) to an active operating position (FIG. 11), which are angularly spaced apart. Such operative positions of the connection member 30 correspond to the connection position D_CON and to the disconnection position D_DIS of the control button 25, respectively.

FIG. 13 schematically represents the rotatable connection member 30 in the active position and an edge 77 of the support frame 40. In the same figure, an electric circuit EC is also represented, in which the electric load R controlled by the dimmer 20, the pair of strips 68A, 68B and the output voltage Vc of the dimmer or rather of the adjustment circuit 50, are schematically represented.

Figure 9:
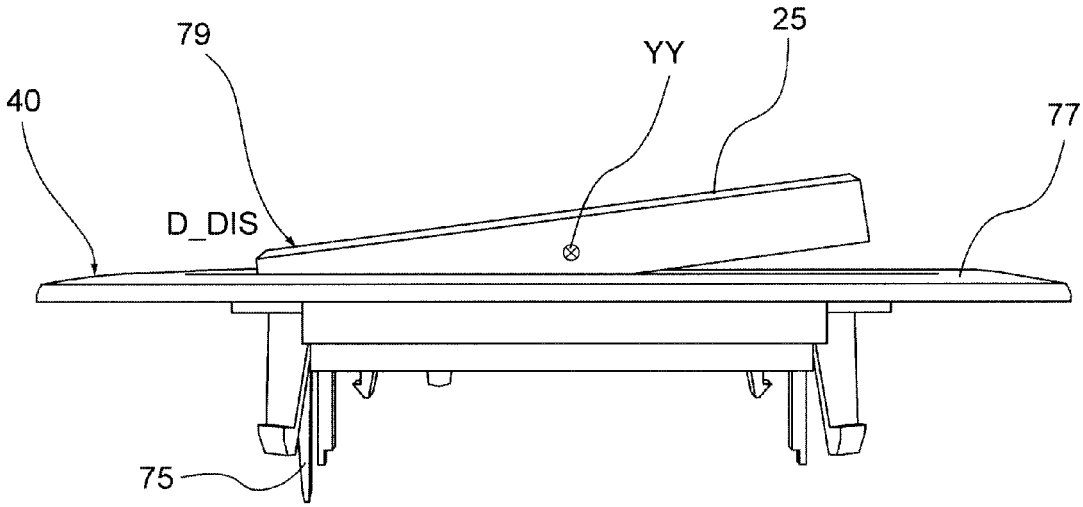
FIG. 9 is a perspective view of the group of parts of FIG. 8 represented in a fourth operating arrangement.

In accordance with the embodiment of FIG. 13, the control arm 75, made, in the example, of electrically insulating material, is suitable for interacting with the strip 68B to disconnect the load R when the rotatable connection member is in the active position, i.e., when the button 25 is in the disconnection position D_DIS (FIG. 9).

Figures 14A, 14B, 14C:
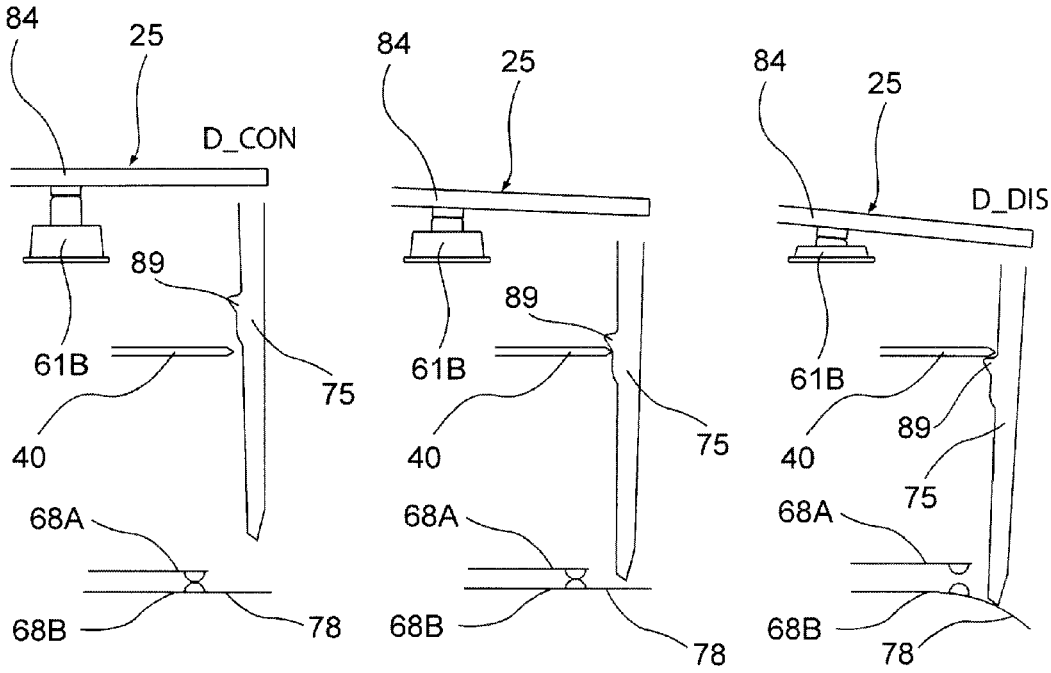
FIG. 14*a* is a view in which some components of the electronic device of FIG. 1 are partially and schematically represented, where such components are represented in a first operating arrangement.
FIG. 14*b* is a view which schematically represents the components of FIG. 14*a*, where such components are represented in a second operating arrangement.
FIG. 14*c* is a view which schematically represents the components of FIG. 14*a*, where such components are represented in a third operating arrangement.

More in particular, with reference to FIG. 14*c*, the control arm is suitable for acting on the strip 68B to elastically deform such strip to move it away from the strip 68A and to consequently open the circuit EC disconnecting the load R. With continued reference to FIG. 14*c*, the strip 68B has an end portion 78 which protrudes with respect to an opposite end portion of the strip 68A. The control arm 75 is suitable for acting on such protruding end portion to space apart the strips 68A, 68B to disconnect the load R.

On the other hand, when the control button is in the connection position D_CON (FIG. 8), the strips 68A, 68B are instead in contact with one another through the respective contact protuberances, to close the circuit EC.

In this regard, in accordance with an embodiment of the disclosure, the control button 25 has a tapered end portion 79 (FIG. 8) or thinned out towards the periphery of the button itself With reference to FIG. 4, the tapered end portion includes two wall portions with variable heights 81, variable, in the embodiment of the figure, with a substantially linear progression, each of which belongs to a respective wall of a pair of walls 83 which are joined and arranged substantially perpendicular to a control wall 84 of the control button 25. The tapered portion 79 allows the stroke of the control arm 75 until the second switching elements 68A, 68B are actuated i.e., in the case of the example, until the control arm bends the strip 68B to open the circuit EC (FIG. 14*c*).

In this regard, the strips 68A, 68B are arranged in a backwards position with respect to the micro-switches 57, 59. In other words, the strips 68A, 68B and the micro-switches 57, 59 are spaced away from one another along a transverse direction, for example perpendicular, with respect to the control wall 84. In other words, the dimmer 20 includes a first circuit layer, in the example substantially corresponding to the acquisition circuit 35, where the micro-switches 57, 59 are located, and a second circuit layer, where the strips 68A, 68B are arranged, which second layer is positioned backwards towards the housing box 55 with respect to the first layer and which, in the example, substantially corresponds to the adjustment circuit 50.

With reference to FIG. 5, a perspective view of the rotatable connection member 30 is shown, in accordance with an embodiment of the present disclosure. With reference to such figure, the rotatable connection member includes at least one return arm 85 which is suitable for applying an elastic return action to bring such member back towards the stand-by position.

In accordance with an embodiment of the disclosure, the return arm is made as a single piece with the connection member 30.

In the example of FIG. 5, the rotatable connection member comprises a pair of return arms 85 each including a respective retaining element or eyelet 87. The eyelets 87 are suitable for each being fitted on a respective elastic cap 61A, 61B to withhold such caps in their operating arrangement (constrained to the respective micro-switches), particularly during the control manoeuvres of the control button 25.

Elastic caps 61A, 61B are suitable for elastically reacting in contrast with the control button when they are pressed by such button. For example, when the control button 25 is in the intermediate operating position (FIG. 14*b*) or in the disconnection position D_DIS, the elastic caps apply a force on the control button which tends to push the button towards the connection position D_CON. More in particular, assuming that the control button is coupled with the rotatable connection member 30 and that such member includes the return arms 85, when the control button is, for example, in the intermediate position or in the disconnection position D_DIS, the force exerted by the caps 61A, 61B is added to the return action exerted by the return arms 85.

With further reference to FIG. 5, the control arm 75 comprises blocking elements 89 to removably fix the control button in the disconnection position D_DIS. In the example, the blocking elements include a blocking protrusion 89 which is suitable for snap-hooking onto a portion of the support frame 40 when the rotatable connection member 30 is in the active position (FIG. 11), i.e., when the control button is in the disconnection position D_DIS (FIGS. 9 and 14*c*).

A mode of operating the electronic manually controllable adjustment device is hereafter described in accordance with an embodiment of the present disclosure.

With reference to FIG. 1, applying pressure on the control button 25, for example, with a finger, to make the button rotate around the adjustment axis XX, allows to carry out the electronic adjustment of the load R. In particular, in the case in which the load R is a lamp, when the control button is in the D_UP and D_DOWN positions, it is possible to increase and decrease the light intensity emitted by the lamp, respectively.

On the other hand, if full pressure is applied to the control button 25, in the example, on the tapered portion 79, in order to rotate the button around the disconnection axis YY until when the button reaches the disconnection position D_DIS, it is possible to carry out the electric disconnection of the load. In order to reconnect the load from the disconnection position, it is sufficient to apply pressure on the button 25 on the opposite side with respect to the tapered portion, thus allowing the button to rotate in a rotation direction opposite the disconnecting direction.

In accordance with a further embodiment of the disclosure, it is also possible to apply pressure on the control button 25 in a way analogous to that for disconnecting the load, but without fully pressing the button. In particular, it is possible to apply pressure on the control button until the aforementioned intermediate position has been reached and then keep the button in such a position, for example, for a few seconds. In this way it is possible to enter the configuration mode of the dimmer i.e., to choose the adjustment curve of the dimmer (not represented), according to the specific requirements. By interrupting the pressure on the control button from the intermediate position (FIG. 14*b*), such a button is automatically drawn back towards the connection position D_CON thanks to the action of the caps 61A, 61B and of the return arms 85.

In such a way the control button is again ready to take on the D_UP and D_DOWN positions so as to allow the load R to be adjusted.

As shown in some of the above embodiments and examples, by virtue of a control button suitable for rotating around two axes perpendicular to one another, the adjustment device allows to carry out a plurality of different functions by exclusively acting upon the control button.

Moreover, through provision of control arm (e.g., control arm 75) it is possible, acting upon the single control button, to carry out both the adjustment and the disconnection of the load, the latter occurring, for example, in case of maintenance operations.

Provision of a rotatable connection member including at least one control arm and at least one return arm, makes it possible to obtain an improved practicality of use of the device by using, at the same time, a reduced number of mechanical components.

The examples set forth above are provided to give those of ordinary skill in the art a complete disclosure and description of how to make and use the embodiments of the electronic manually controllable adjustment device of the disclosure, and are not intended to limit the scope of what the applicants regard as their disclosure. Modifications of the above-described modes for carrying out the disclosure may be used by persons of skill in the art, and are intended to be within the scope of the following claims.

It is to be understood that the disclosure is not limited to particular devices, products, methods or systems, which can, of course, vary. It is also to be understood that the terminology used herein is for the purpose of describing particular embodiments only, and is not intended to be limiting. As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

A number of embodiments of the disclosure have been described. Nevertheless, it will be understood that various modifications may be made without departing from the spirit and scope of the present disclosure. Accordingly, other embodiments are within the scope of the following claims.

The invention claimed is:

1. An electronic manually controllable adjustment device for adjusting electric power provided to an electric load connectable to the device, the device comprising:

first switching elements including a first switching device and a second switching device;

a tilting control button adapted to interact with said first switching elements;

first hinge elements, for defining a first hinge axis for allowing the control button to rotate around said first hinge axis, between a first operating position and a second operating position angularly spaced therebetween, the control button adapted to interact with said first switching elements for respectively actuating the first switching device and the second switching device when reaching the first operating position and the second operating position;

second switching elements; and second hinge elements for defining a second hinge axis perpendicular to first hinge axis, said second hinge elements being adapted to allow rotation of the control button around the second hinge axis, between a third operating position and a fourth operating position angularly spaced therebetween, for actuation of the second switching elements, wherein the first switching device and the second switching device are positioned on the same side with respect to the second hinge axis.

2. An electronic manually controllable adjustment device for adjusting electric power provided to an electric load connectable to the device, the device comprising:

first switching elements including a first switching device and a second switching device;

a tilting control button adapted to interact with said first switching elements;

first hinge elements, for defining a first hinge axis for allowing the control button to rotate around said first hinge axis between a first operating position and a second operating position angularly spaced therebetween, the control button adapted to interact with said first switching elements for respectively actuating the first switching device and the second switching device when reaching the first operating position and the second operating position;

second switching elements;

second hinge elements for defining a second hinge axis perpendicular to first hinge axis, said second hinge elements being adapted to allow rotation of the control button around the second hinge axis, between a third operating position and a fourth operating position angularly spaced therebetween, for actuation of the second switching elements;

a first circuit layer, at which the first switching elements are provided, and a second circuit layer, positioned backwards with respect to the first layer, at which the second switching elements are provided.

3. An electronic manually controllable adjustment device for adjusting electric power provided to an electric load connectable to the device, the device comprising:

first switching elements including a first switching device and a second switching device;

a tilting control button adapted to interact with said first switching elements;

first hinge elements, for defining a first hinge axis for allowing the control button to rotate around said first hinge axis between a first operating position and a second operating position angularly spaced therebetween, the control button adapted to interact with said first switching elements for respectively actuating the first switching device and the second switching device when reaching the first operating position and the second operating position;

second switching elements; and second hinge elements for defining a second hinge axis perpendicular to first hinge axis, said second hinge elements being adapted to allow rotation of the control button around the second hinge axis, between a third operating position and a fourth operating position angularly spaced therebetween, for actuation of the second switching elements, wherein the control button is adapted to achieve a further intermediate operating position, angularly spaced apart from said third operating position and fourth operating position, around second hinge axis, the control button interacting with the first switching elements for simultaneous actuation of the first switching device and the second switching device when assuming said intermediate operating position.

4. An electronic manually controllable adjustment device for adjusting electric power provided to an electric load connectable to the device, the device comprising:

first switching elements including a first switching device and a second switching device;

a tilting control button adapted to interact with said first switching elements;

first hinge elements, for defining a first hinge axis for allowing the control button to rotate around said first hinge axis between a first operating position and a second operating position angularly spaced therebetween, the control button adapted to interact with said first switching elements for respectively actuating the first switching device and the second switching device when reaching the first operating position and the second operating position;

second switching elements;

second hinge elements for defining a second hinge axis perpendicular to first hinge axis, said second hinge elements being adapted to allow rotation of the control button around the second hinge axis, between a third operating position and a fourth operating position angularly spaced therebetween, for actuation of the second switching elements, and at least one control arm transversely positioned with respect to control button and integral with said button during rotation around the second hinge axis, the control arm interacting with the second switching elements for actuation thereof when achieving the fourth operating position, the second switching elements including at least an electric contact element, the control arm being adapted to elastically deform said electric contact element in order to disconnect the electric load when the control button reaches the fourth operating position.

5. An electronic manually controllable adjustment device for adjusting electric power provided to an electric load connectable to the device, the device comprising:

first switching elements including a first switching device and a second switching device;

a tilting control button adapted to interact with said first switching elements;

first hinge elements, for defining a first hinge axis for allowing the control button to rotate around said first hinge axis between a first operating position and a second operating position angularly spaced therebetween, the control button adapted to interact with said first switching elements for respectively actuating the first switching device and the second switching device when reaching the first operating position and the second operating position;

second switching elements;

second hinge elements for defining a second hinge axis perpendicular to first hinge axis, said second hinge elements being adapted to allow rotation of the control button around the second hinge axis, between a third operating position and a fourth operating position angularly spaced therebetween, for actuation of the second switching elements; and at least one control arm transversely positioned with respect to control button and integral with said button during rotation around the second hinge axis, the control arm interacting with the second switching elements for actuation thereof when achieving the fourth operating position, the control button comprising an end portion tapered towards the button periphery, for allowing the control arm to move until such arm activates the second switching elements.

6. An electronic manually controllable adjustment device for adjusting electric power provided to an electric load connectable to the device, wherein the device comprises:

first switching elements including a first switching device and a second switching device;

a tilting control button adapted to interact with said first switching elements;

first hinge elements, for defining a first hinge axis for allowing the control button to rotate around said first hinge axis between a first operating position and a second operating position angularly spaced therebetween, the control button adapted to interact with said first switching elements for respectively actuating the first switching device and the second switching device when reaching the first operating position and the second operating position;

second switching elements;

second hinge elements for defining a second hinge axis perpendicular to first hinge axis, said second hinge elements being adapted to allow rotation of the control button around the second hinge axis, between a third operating position and a fourth operating position angularly spaced therebetween, for actuation of the second switching elements; and at least one control arm transversely positioned with respect to control button and integral with said button during rotation around the second hinge axis, the control arm interacting with the second switching elements for actuation thereof when achieving the fourth operating position, said control arm comprising blocking elements for removably blocking the control button in the fourth operating position.

7. An electronic manually controllable adjustment device for adjusting electric power provided to an electric load connectable to the device, wherein the device comprises:

first switching elements including a first switching device and a second switching device;

a tilting control button adapted to interact with said first switching elements;

first hinge elements, for defining a first hinge axis for allowing the control button to rotate around said first hinge axis, between a first operating position and a second operating position angularly spaced therebetween, the control button adapted to interact with said first switching elements for respectively actuating the first switching device and the second switching device when reaching the first operating position and the second operating position;

second switching elements;

second hinge elements for defining a second hinge axis perpendicular to first hinge axis, said second hinge elements being adapted to allow rotation of the control button around the second hinge axis, between a third operating position and a fourth operating position angularly spaced therebetween, for actuation of the second switching elements;

at least one control arm transversely positioned with respect to control button and integral with said button during rotation around the second hinge axis, the control arm interacting with the second switching elements for actuation thereof when achieving the fourth operating position; and a support frame and a rotatable connection member, including said control arm and adapted to be operatively interposed between the support frame and the control button, wherein:

the control button is hinged to said connection member by way of first hinge elements in order to rotate around the first hinge axis, the rotatable connection member is hinged to the support frame by way of second hinge elements in order to rotate around said second hinge axis, the control button is mounted to overlap said rotatable connection member, and said connection member is rotatable around the second hinge axis between a stand-by operating position and an active operating position, angularly spaced therebetween, the rotatable connection member comprising at least one return arm adapted to apply an elastic return action for returning said member towards the stand-by position.

8. The electronic manually controllable adjustment device according to claim 7, wherein said at least one return arm is integrally formed with the rotatable connection member.

9. The electronic manually controllable adjustment device according to claim 7, wherein the first switching elements comprise at least one elastic cap, and wherein said at least one return arm comprises a retaining element, for holding said cap.

* * * * *